US006887112B2

(12) United States Patent
Kuroki et al.

(10) Patent No.: US 6,887,112 B2
(45) Date of Patent: May 3, 2005

(54) CONNECTOR WITH SHORT INTERVAL ARRANGEMENTS OF CONTACTS

(75) Inventors: Yoshihide Kuroki, Tachikawa (JP); Yoshifumi Kubota, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/695,370

(22) Filed: Oct. 28, 2003

(65) Prior Publication Data

US 2004/0087188 A1 May 6, 2004

(30) Foreign Application Priority Data

Oct. 31, 2002 (JP) ..... 2002-317106

(51) Int. Cl.[7] ..... H01R 13/40

(52) U.S. Cl. ..... 439/733.1; 439/752; 439/595; 439/603

(58) Field of Search ..... 439/733.1, 752, 439/595, 603

(56) References Cited

U.S. PATENT DOCUMENTS 4,653,837 A 3/1987 Phillipson et al.
4,946,399 A * 8/1990 Kawashima ..... 439/752
5,700,162 A * 12/1997 Hatagishi et al. ..... 439/595
5,779,489 A 7/1998 Davis et al.
5,830,013 A * 11/1998 Saito et al. ..... 439/595
5,859,534 A * 1/1999 Saijo et al. ..... 324/538
5,947,775 A 9/1999 Yamamoto et al.
6,354,873 B1 * 3/2002 Morello et al. ..... 439/595
6,435,920 B2 * 8/2002 Kashiyama ..... 439/752
6,655,999 B2 * 12/2003 Mase et al. ..... 439/752

* cited by examiner

*Primary Examiner*—Truc Nguyen
(74) *Attorney, Agent, or Firm*—Collard & Roe, P.C.

(57) ABSTRACT

A connector comprises contact pins, an insulator and a supplementary insulator. Each of the contact pins comprises a supported portion and a contact end. The insulator comprises accommodation portions which accommodate the respective contact pins. Each of the accommodation portions is provided with a supporting portion which includes a supporting surface and supports the supported portion of the corresponding contact pin. The supplementary insulator is fixedly held by the insulator. At least one part of the supported portion of the contact pin is placed between the supporting surface and the supplementary insulator in a Z-direction. Therefore, the supported portion always straightly extends in a Y-direction so that the contact end can be surely positioned at a predetermined position.

11 Claims, 14 Drawing Sheets

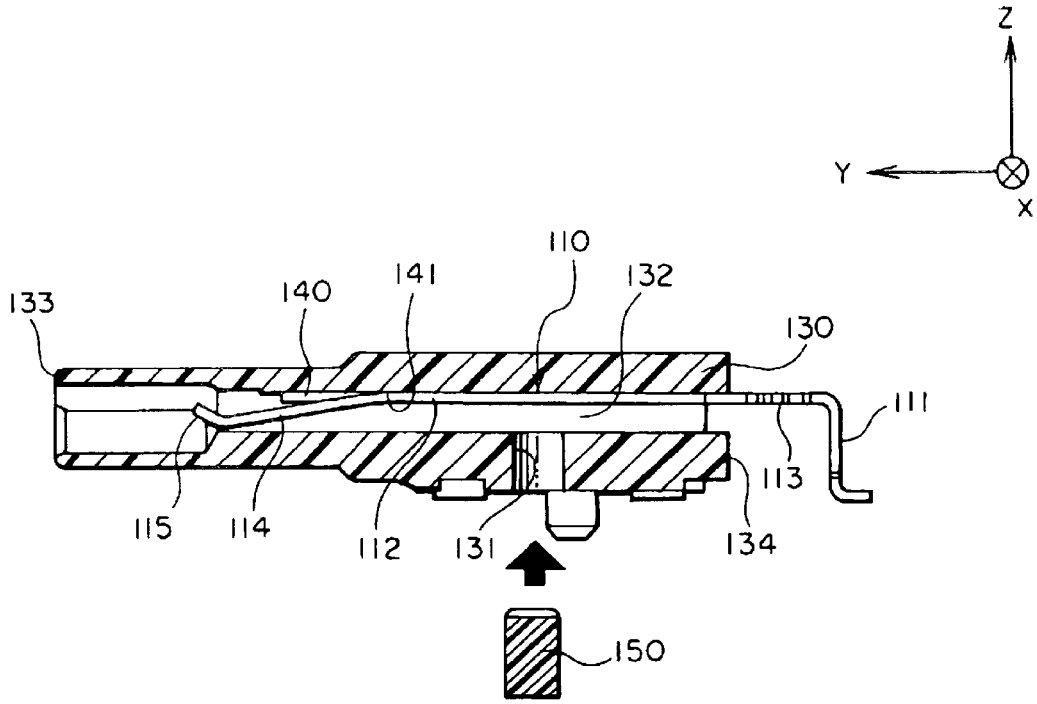
FIG. 17
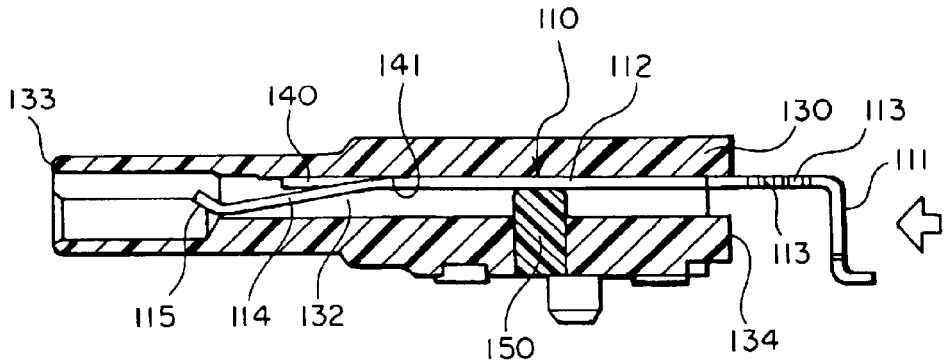
FIG. 18
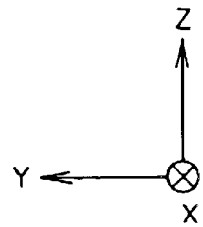

CONNECTOR WITH SHORT INTERVAL ARRANGEMENTS OF CONTACTS

This application claims priority to prior Japanese patent application JP 2002-317106, the disclosure of which is incorporated herein by reference.

BACKGROUND OF THE INVENTION:

This invention relates to a connector which comprises a plurality of contact pins held by an insulator and arranged at short intervals in the insulator.

Each contact pin is comprised of a supported portion extending straightly, a contact end and a connecting portion connecting the supported portion and the contact end. The supported portion has a flat narrow plate like shape. The connecting portion extends from the supported portion in a direction oblique to the extending direction of the supported portion. The insulator is formed with accommodation portions. The supported portion is supported by the corresponding accommodation portion. In detail, each accommodation portion has a T-like shaped cross-section in a plane perpendicular to the extending direction of the supported portion. The wider part of the accommodation portion holds and supports the supported portion. With the above-mentioned structure, the position of the contact end depends on the position of the supported portion. In other words, depending on whether the supported portion is surely and suitably supported by the accommodation portion, the position of the contact end of the contact pin is determined.

The short interval arrangements of the contact pins cause one problem as to the positioning of the contact ends. Even if the interval or pitch between the neighboring contact pins becomes shorter, the width of the contact ends should be kept unchanged or be changed with a very small change, as well as the wall thickness between the neighboring accommodation portions because of electrical and mechanical requirements. Therefore, as the interval between the neighboring contact pins becomes shorter, the width of the neighboring supported portions should become narrower as well as the corresponding part of the accommodation portion. As a result, it is difficult that the supported portion is surely supported by the accommodation portion of the insulator.

Thus, there is a need for a connector which can surely support the supported portion of each contact pin by the insulator so that the contact end of the contact pin is positioned at its suitable position.

SUMMARY OF THE INVENTION

It is therefore an object of the present invention to provide a connector which can surely support contact pins and can arrange their ends at their suitable positions.

According to the present invention, there is provided a connector comprising a plurality of contact pins; an insulator supporting the contact pins in a state arranged in a first direction. Each of the contact pins comprises a supported portion which extends in a second direction perpendicular to the first direction. The insulator comprises a plurality of accommodation portions which accommodate the respective contact pins. Each of the accommodation portions is provided with a supporting portion which supports the supported portion of the corresponding contact pin. The supporting portion includes a supporting surface which receives the supported portion of the corresponding contact pin in a third direction perpendicular to the first and the second directions. The connector further comprises a supplementary insulator fixedly held by the insulator and pushing at least one part of the supported portion of each of the contact pins to the supporting surface to hold the at least one part of the supported portion between the supporting surface and the supplementary insulator.

Preferred developments of the invention are defined in the dependent claims and the method claim thereof.

BRIEF DESCRIPTION OF THE DRAWINGS:

FIG. 17 is a cross-sectional view showing a process of the fabrication method shown with a black arrow in FIG. 16; and FIG. 18 is a cross-sectional view showing another process of the fabrication method shown with a hollow or white arrow in FIG. 16.

DESCRIPTION OF PREFERRED EMBODIMENTS

Figure 1:
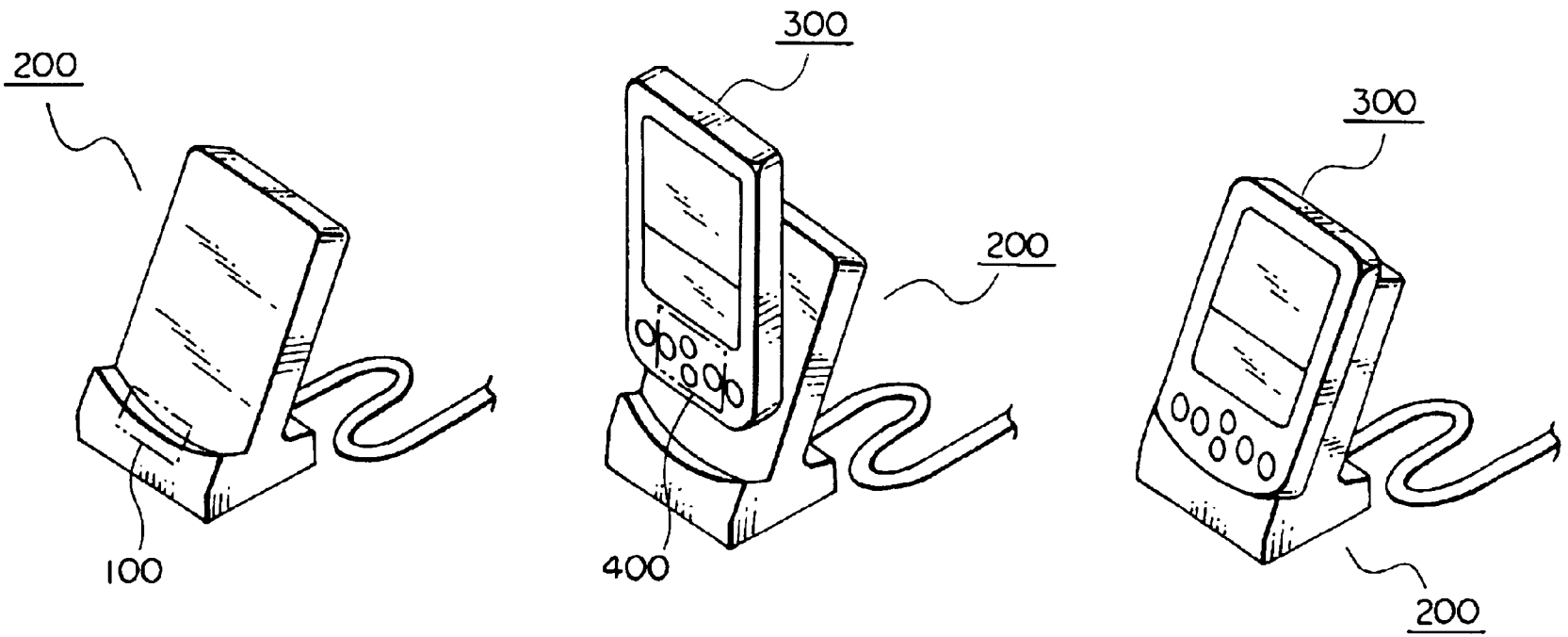
FIG. 1 is a schematic view showing an overview of an application use of a connector according to one embodiment of the present invention.
Figure 2:
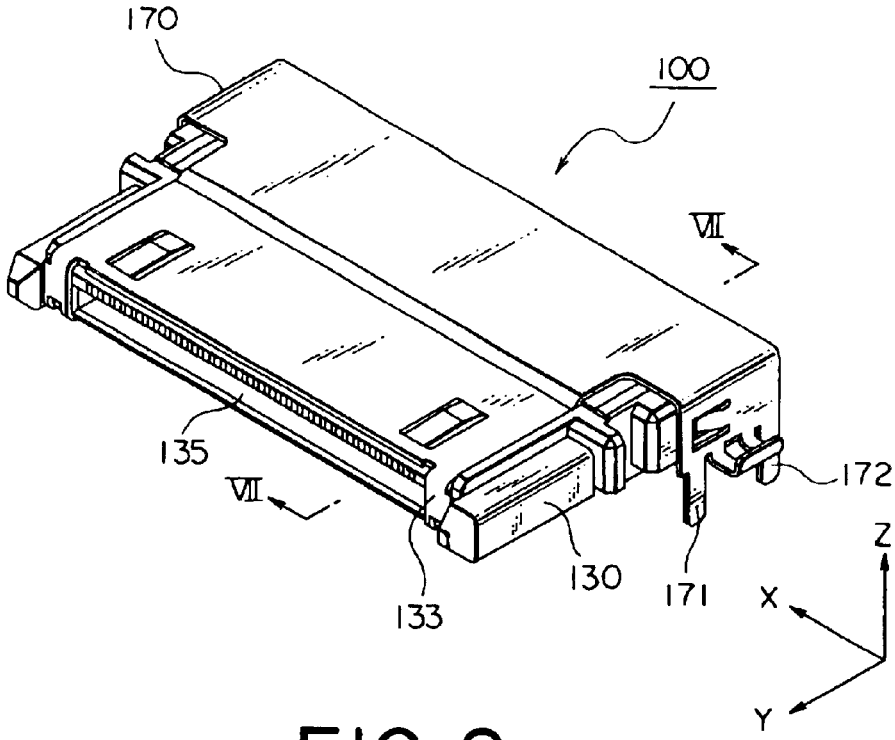
FIG. 2 is a front oblique view showing the connector of FIG. 1.
Figure 3:
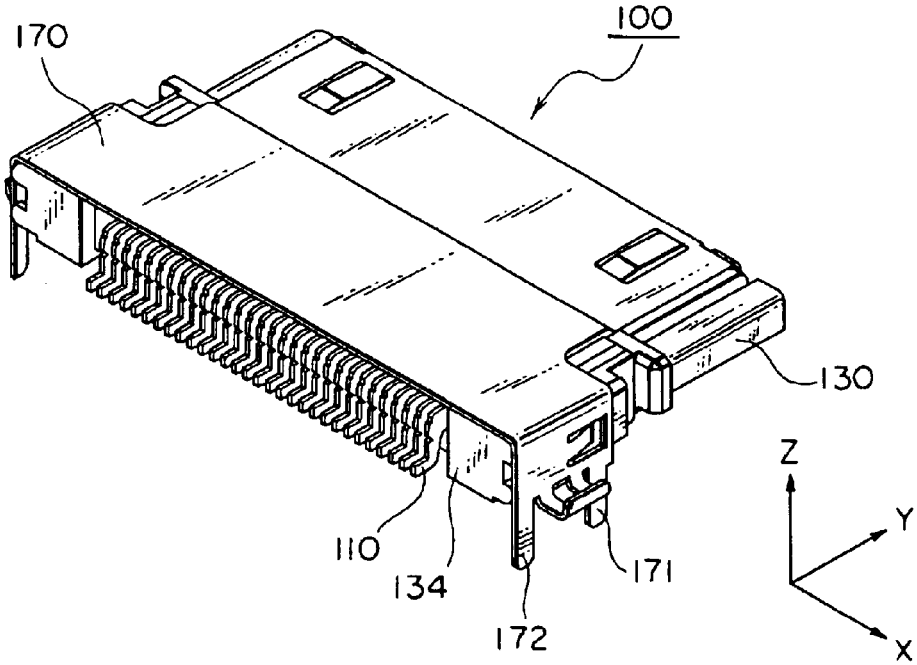
FIG. 3 is a rear oblique view showing the connector of FIG. 2.
Figure 4:
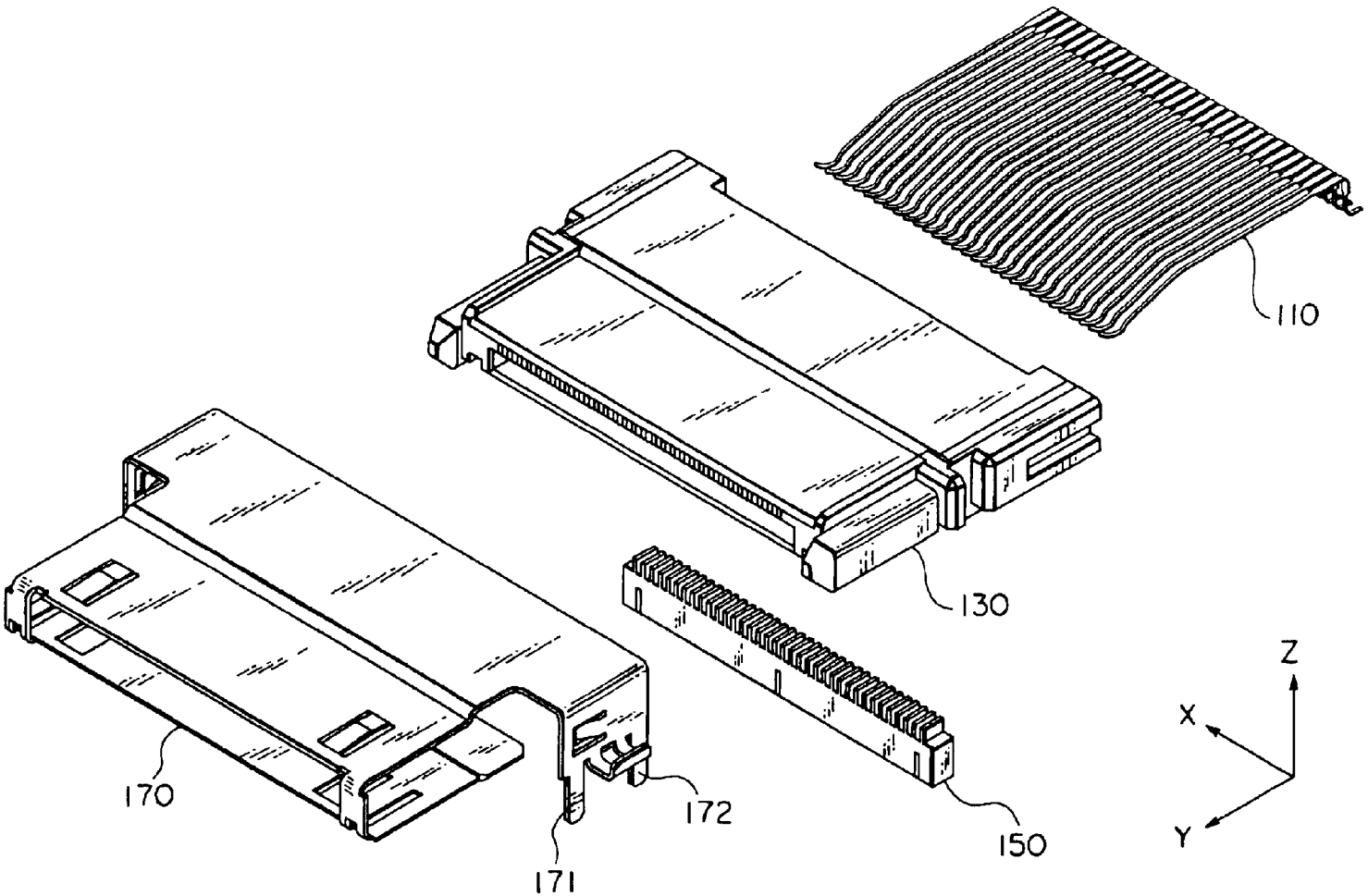
FIG. 4 is an exploded, perspective view showing the connector of FIG. 2.

With reference to FIG. 1, a connector 100 according to one embodiment of the present invention is installed into a cradle 200 for a personal data assistant (PDA) or a mobile intelligent terminal 300. The PDA 300 comprises a connector 400 as a mating connector of the connector 100. When the PDA 300 is put on the cradle 200, the connector 100 is mated with the mating connector 400.

With reference to FIGS. 2 to 4 and FIG. 7, the connector 100 comprises a plurality of contact pins 110, an insulator 130, a supplementary insulator 150 and a shell 170. The insulator 130 holds the contact pins 110 in cooperation with the supplementary insulator 150 so that the contact pins 110 are arranged in an X-direction. The shell 170 covers the insulator 130 as well as the contacts 110 and the supplementary insulator 150.

Figure 5:
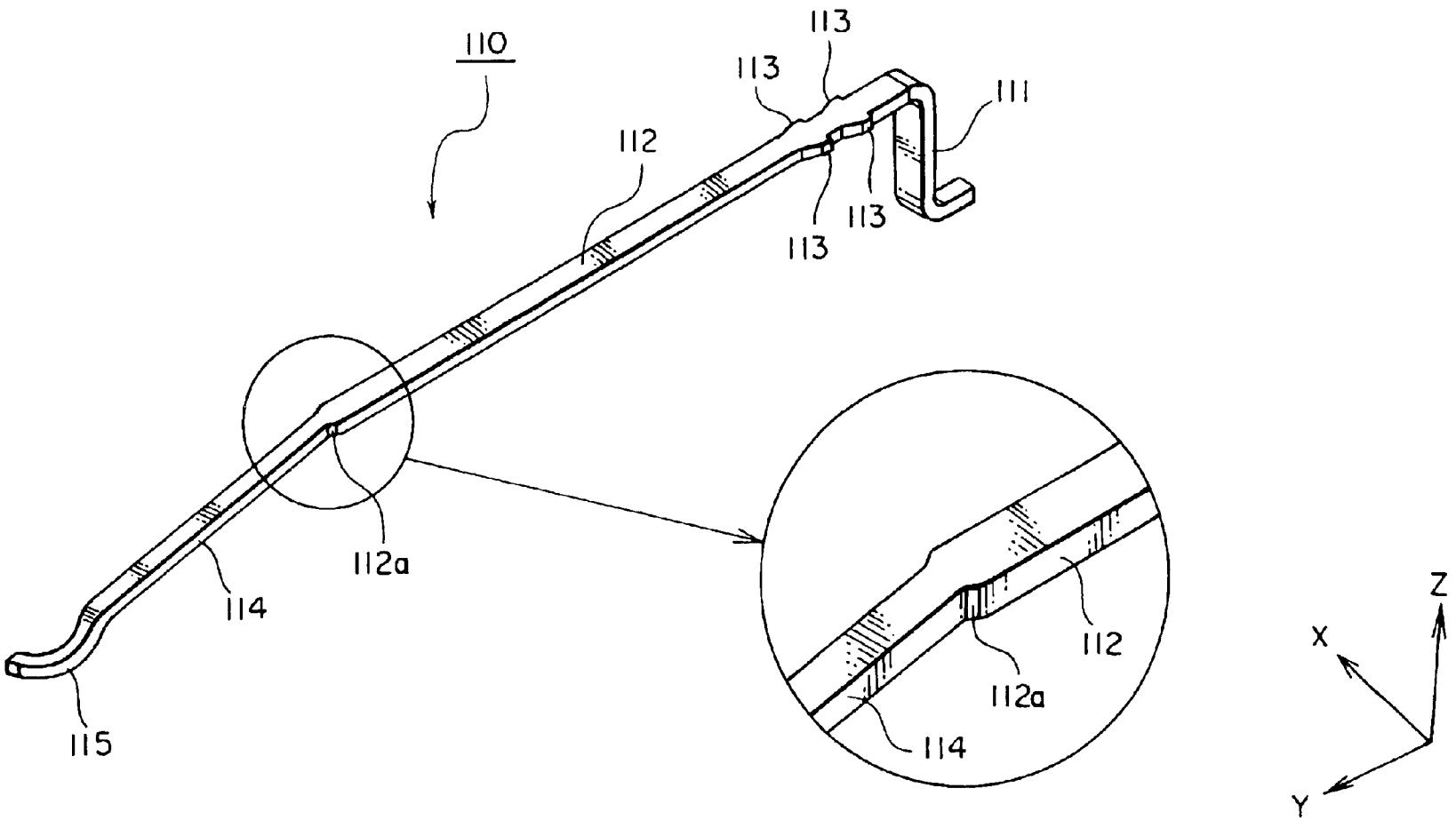
FIG. 5 is a perspective view showing a contact pin included in the connector of FIG. 2.
Figure 7:
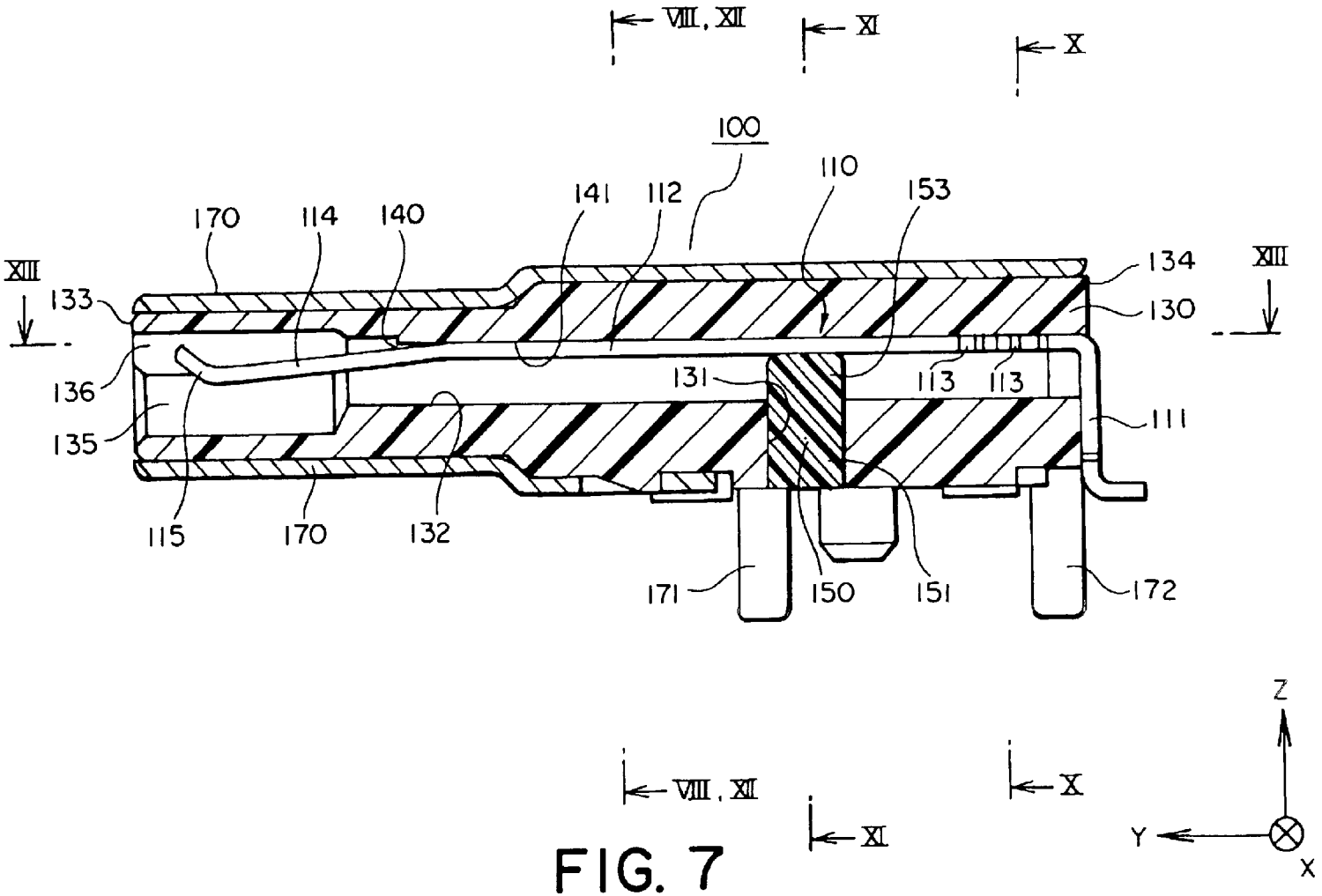
FIG. 7 is a cross-sectional view showing the connector of FIG. 2, taken along lines VII—VII.

With reference to FIG. 5, each contact pin 110 is comprised of a terminal end 111, a supported portion 112 formed with press-fit portions 113, a connecting portion 114, and a contact end 115. The terminal end 111 has an L-like shape and is to be connected to a signal line or a ground line of a circuit provided in the cradle 200. The supported portion 112 straightly extends from the terminal end 111 so that the supported portion 112 and the terminal end 111 make an almost right angle. The supported portion 112 has a flat narrow plate like shape. As shown in FIG. 7, the extending direction of the supported portion 112 is a Y-direction under the assembled state of the connector 100. As shown in FIG. 5, each press-fit portion 113 has a barb like shape and projects from the corresponding side edge of the supported portion 112 in a direction perpendicular to the extending direction of the supported portion 112. In other words, the press-fit portion 113 projects in the X-direction under the assembled state. The position of the press-fit portion 113 is nearer to the terminal end 111 than to the contact end 115. From an end of the supported portion 112 opposite to the end connected to the terminal end 111, the connecting portion 114 extends in a direction oblique to the extending direction of the supported portion and the projecting direction of the press-fit portion. The connecting portion 114 connects the supported portion 112 and the contact end 115. The contact end 115 is a flared free end of the contact pin 110. The contact end 115 and the connecting portion 114 have a width narrower than the supported portion 112 so that the contact pin 110 has shoulder portions 112*a* as shown in an enlarged circle of FIG. 5.

Figure 6:
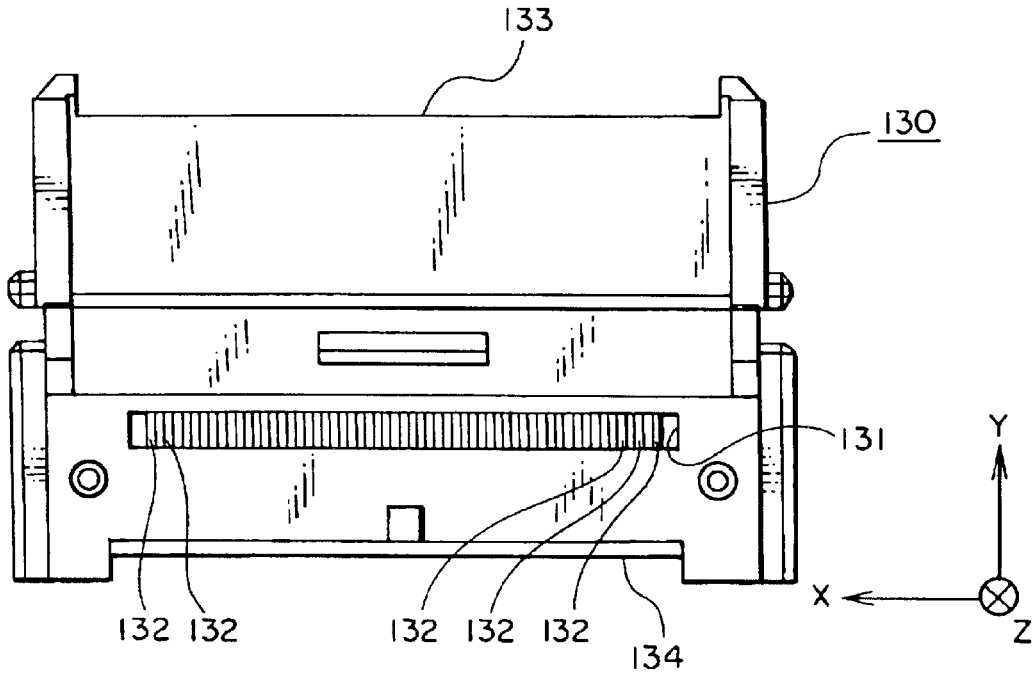
FIG. 6 is a bottom view showing an insulator included in the connector of FIG. 2.
Figure 8:
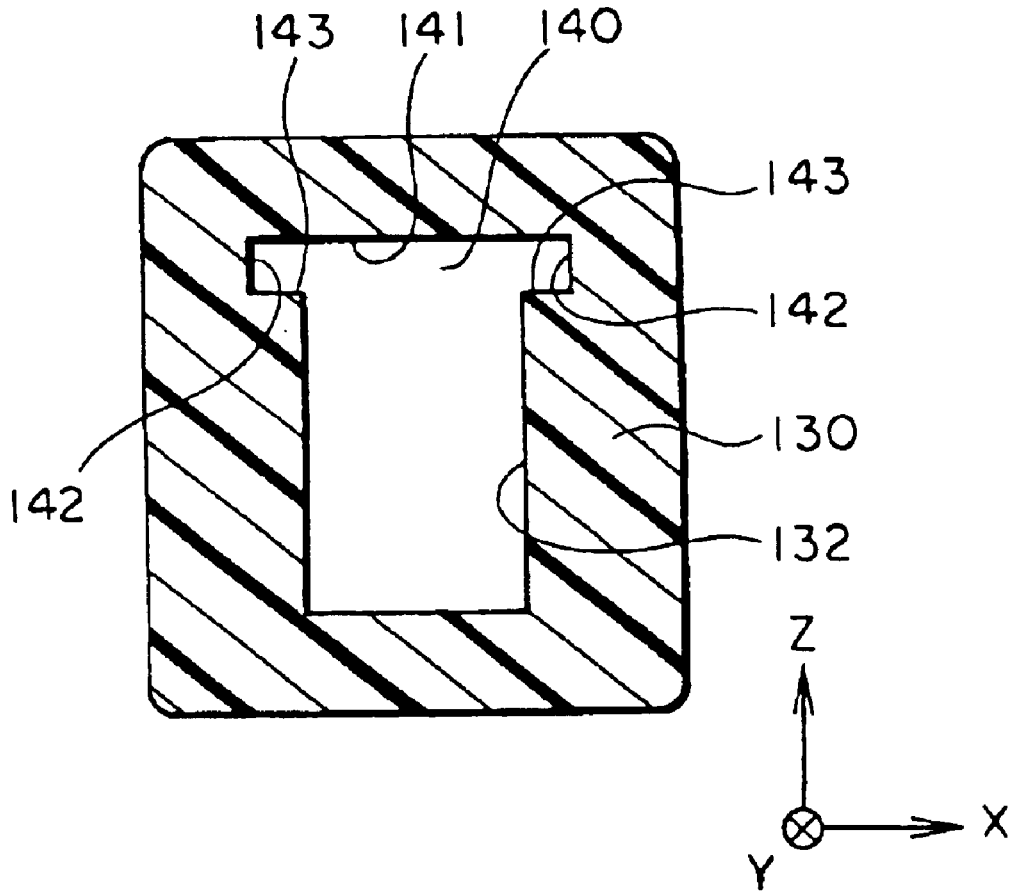
FIG. 8 is a partial, cross-sectional view showing the connector of FIG. 7, taken along lines VIII—VIII.

With reference to FIGS. 6 to 8, the insulator 130 has a hole 131 and a plurality of accommodation portions 132. The hole 131 extends in the X-direction and communicates between the bottom surface of the insulator 130 and the accommodation portions 132. The accommodation portions 132 extend in the Y-direction and are arranged in the X-direction.

Figure 15:
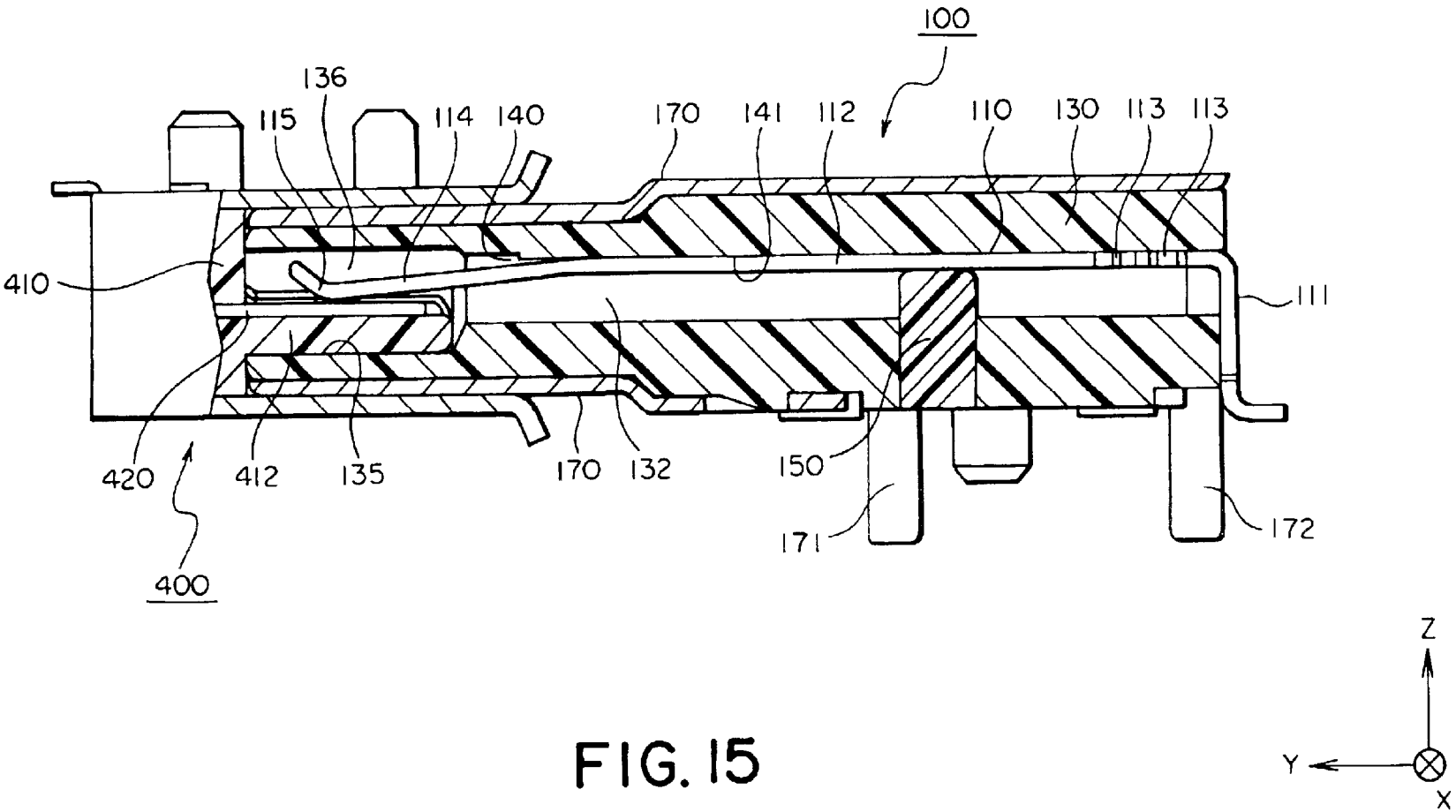
FIG. 15 is a cross-sectional view showing the connector of FIG. 2 and the mating connector of FIG. 14 under the mated state.

As shown in FIG. 7, the insulator 130 has a front end 133 and a rear end 134 in the Y-direction. The front end 133 of the insulator 130 is an open end and is provided with a receiving portion 135 and a plurality of recesses 136 so that the front end 133 serves as an interface with the mating connector 400, as shown in FIG. 15. The recesses 136 serve to receive the respective contact ends 115 upon the mating of the connector 100 with the mating connector 400. As shown in FIG. 7, the accommodation portion 132 extends from the rear end 134 of the insulator 130 to the receiving portion 135 and the corresponding recess 136.

As shown in FIG. 8, the accommodation portion 132 generally has a T-like shaped cross-section, except for its part directly connected to the hole 131. The wider part of the T-like shaped cross-section is a supporting portion 140 which supports the supported portion 112 of the contact pin 110. The supporting portion 140 has a supporting surface 141, which is perpendicular to a Z-direction. The supporting portion 140 also has sidewalls 142, in which the press-fit portions 113 are engaged upon the fitting of the contact pins 110 to the insulator 130. Because the supporting portion 140 is the wider part of the accommodation portion 132, the sidewalls 142 are different, in the X-direction, from sidewalls of the other portion of the accommodation portion 132 so that there are steps 143 between the supporting portion 140 and the other portion of the accommodation portion 132. The supporting surface 141 and the steps 143 receive the supported portion 112 of the contact pin 110 so that the supported portion 112 is supported.

Figure 13:
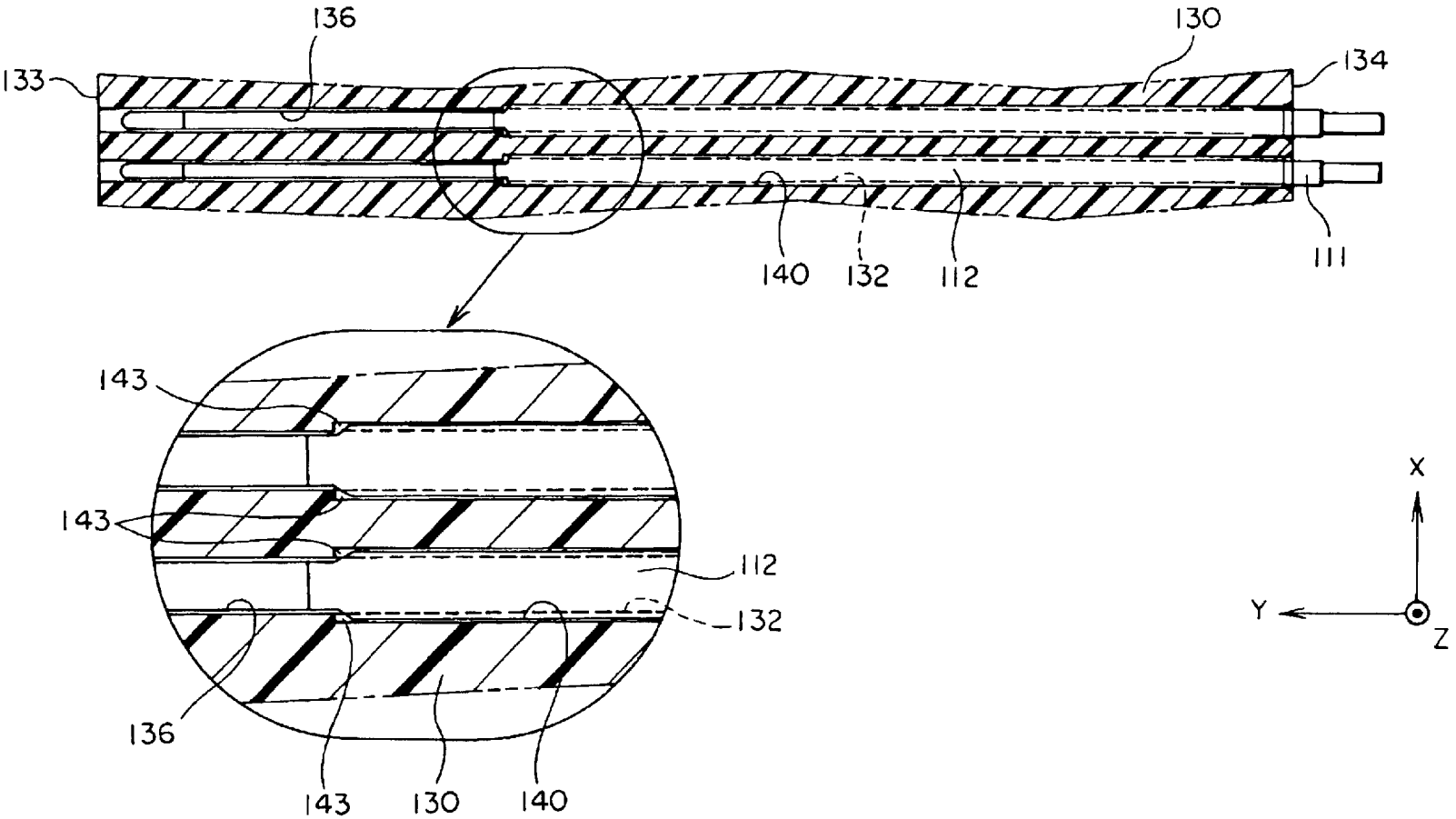
FIG. 13 is a partial, cross-sectional view showing the connector of FIG. 7, taken along lines XIII—XIII.

As shown in FIG. 13, the supporting portion 140 is wider than the corresponding recess 136 in the X-direction, while the other portion of the accommodation portion 132 is substantially equal in size to the recess 136 in the X-direction. Basically, with the structure, the shoulder portions 112*a* of the contact pin 110 are prevented from going beyond the boundary between the supporting portion 140 and the recess 136 towards the recess 136. The connecting portion 114 and the contact end 115 are accommodated in the receiving portion 135 of the insulator 130.

As mentioned above, the short interval arrangements of the contact pins cause the sizes of the steps 143 to become small. Also, they cause the width of the supported portion 112 of each contact pin 110 to become small. Therefore, it becomes difficult to surely support the supported portion 112 by using only the supporting portion 140 of the insulator 130. To assist the support, the connector 100 according to the present embodiment uses the supplementary insulator 150.

Figure 9:
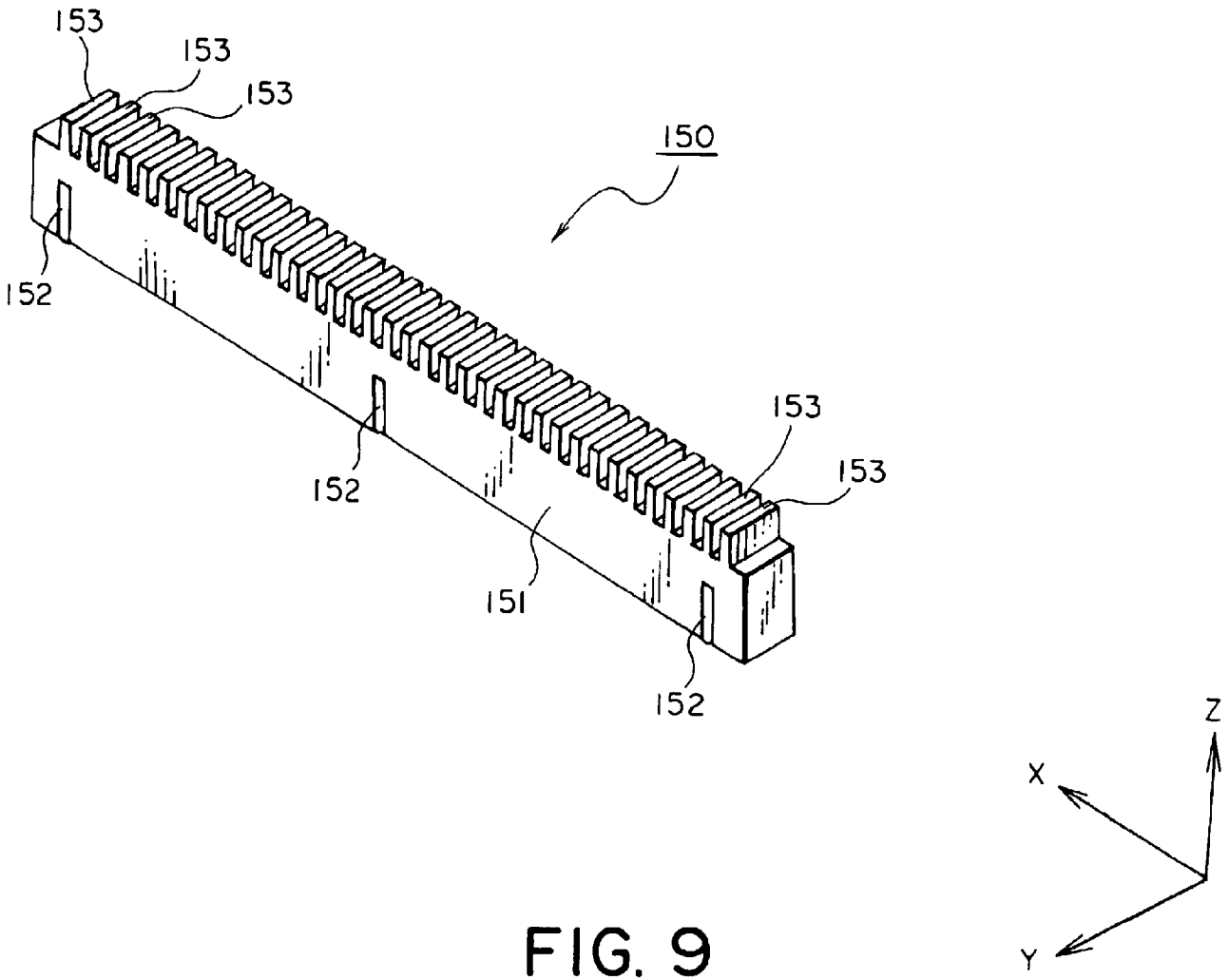
FIG. 9 is a perspective view showing a supplementary insulator included in the connector of FIG. 2.

With reference to FIG. 9, the supplementary insulator 150 is comprised of a base portion 151, a plurality of protrusions 152 and a plurality of pressing portions 153. The base portion 151 is generally a rectangular parallelepiped and extends in the X-direction. The protrusions 152 are dowels in this embodiment and are bulged in the Y-direction. Upon the fitting of the supplementary insulator 150 to the insulator 130, the protrusions 152 are engaged in the inner wall of the hole 131 of the insulator 130 to fix the base portion 151 of the supplementary insulator 150 into the hole 131 of the insulator 130. The protrusions 152 may be simply removed, and another fixing means may be adopted instead of the protrusions 152.

Figure 11:
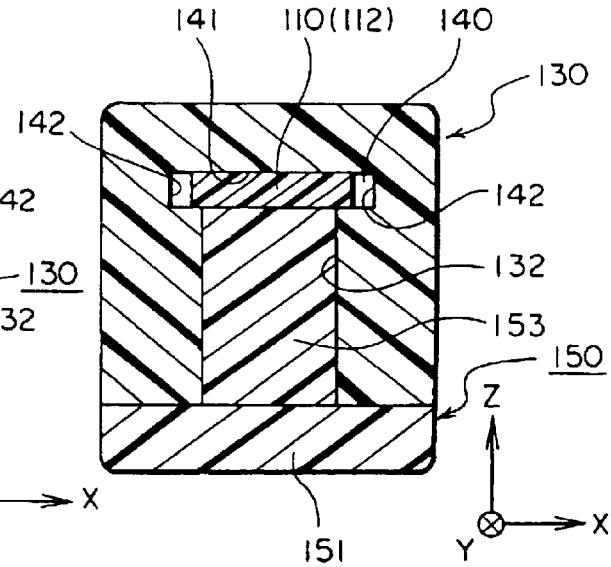
FIG. 11 is a partial, cross-sectional view showing the connector of FIG. 7, taken along lines XI—XI.

The pressing portions 153 are arranged in the X-direction. Each of the pressing portions 153 has a flat plate like shape and extends from the base portion 151 in the Z-direction. As seen from FIG. 7, when the base portion 151 is fixedly fitted within the hole 131 of the insulator 130, the pressing portions 153 are inserted into the respective accommodation portions 132 to press the respective supported portion 112 against the respective supporting surfaces 141. In other words, each of the supported portions 112 is partially placed between the corresponding pressing portion 153 and the corresponding supporting surface 141 in the Z-direction, as best shown in FIGS. 7 and 11.

Figure 10:
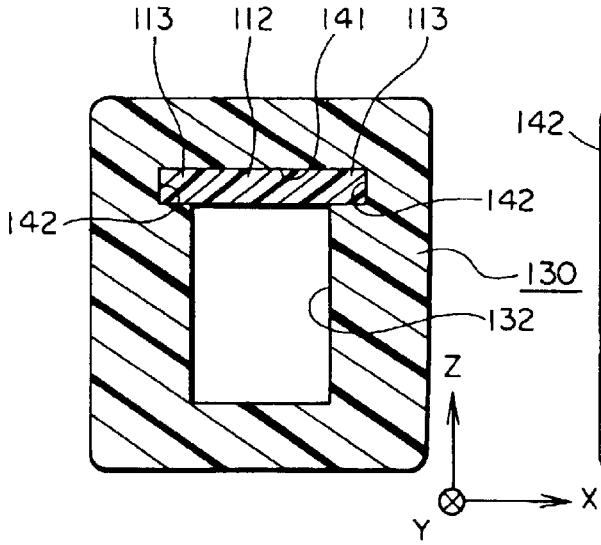
FIG. 10 is a partial, cross-sectional view showing the connector of FIG. 7, taken along lines X—X.
Figure 12:
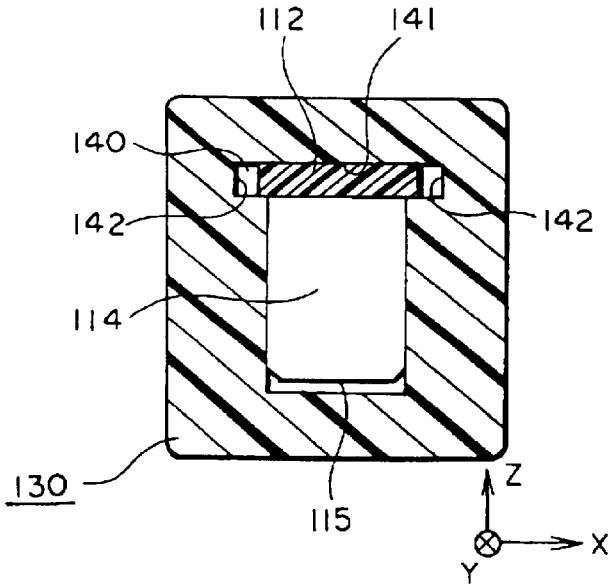
FIG. 12 is a partial, cross-sectional view showing the connector of FIG. 7, taken along lines XII—XII.

In this embodiment, the supplementary insulator 150 is positioned nearer to the front end 133 of the insulator 130 than the press-fit portions 113 of the contact pins 110. As seen from FIGS. 10 to 12, all of the supported portions 112 are surely supported by the respective supporting portions 140. The connecting portions 114 substantially extend in the same direction as each other. Therefore, the contact ends 115 are positioned on the same level as each other. The arrangements of the contact ends 115 make a contribution to reliable electrical connections between the contact pins 110 and other contact pins of the mating connector 400. The supplementary insulator 150 may be positioned around the press-fit portions 113. Also, the supplementary insulator 150 may be positioned nearer to the receiving portion 135 than the present embodiment illustrated in FIG. 7.

The shell 170 covers the insulator 130 holding the contact pins 110 and the supplementary insulator 150, except for the front and the rear ends 133, 134 of the insulator 130 and a part of the bottom surface of the insulator 130. The shell 170 is provided with mounting posts 171, 172, which extend beyond the bottom surface of the insulator 130 in the Z-direction. The mounting posts 171, 172 serve to fix the connector 100 to a substrate (not shown) provided within the cradle 200. With this structure, the shell 170 electrically shields the connector 100 from noises.

Figure 14:
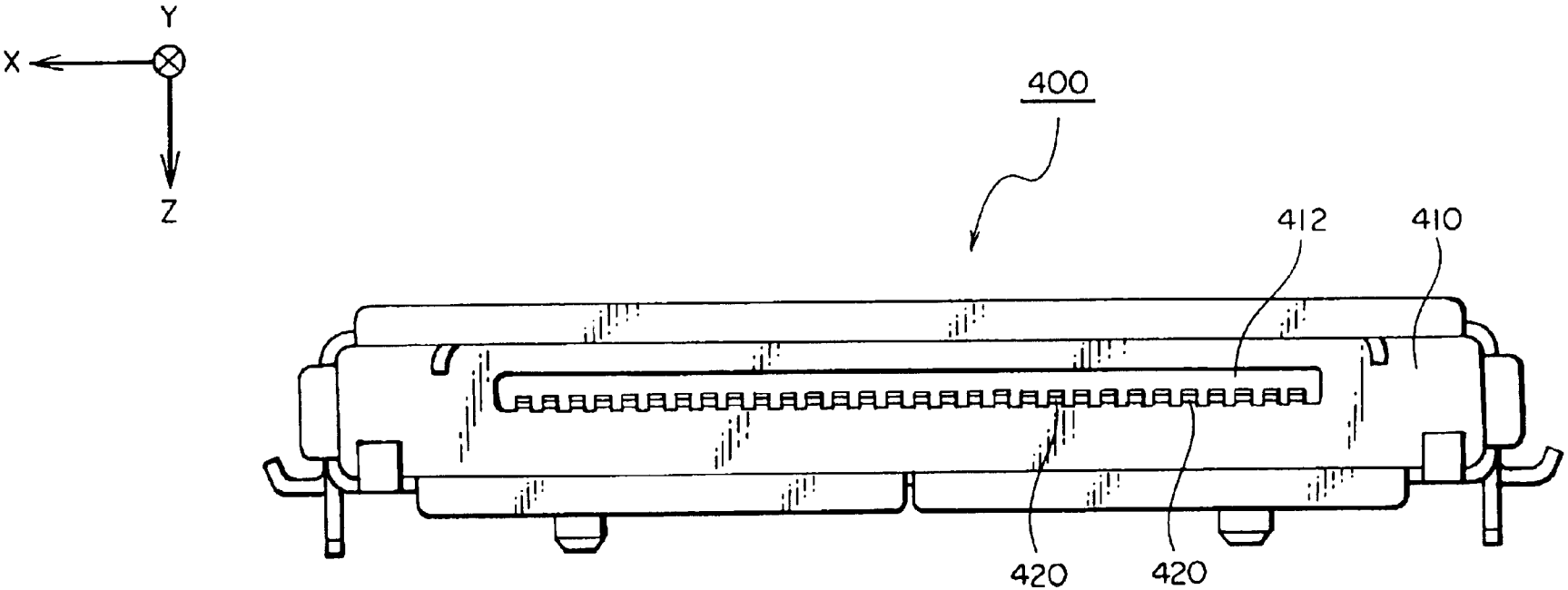
FIG. 14 is a front view showing a mating connector which is to be mated with the connector of FIG. 2.

With reference to FIGS. 14 and 15, the mating connector 400 has another insulator 410 and another set of contact pins 420. In detail, the insulator 410 has a flat plate like shaped projection 412, which serves as a fitting portion to the connector 100 and is received within the receiving portion 135 of the connector 100, as shown in FIG. 15. The contact pins 420 are arranged in one surface of the projection 412. Specifically, the contact pins 420 are accommodated in grooves, respectively, which are formed in the surface of the projection 412. As shown in FIG. 15, when the connector 100 is mated with the mating connector 400, the contact end 115 is brought into contact with the corresponding contact 420, while being pressed in the Z-direction so that the corresponding recess 136 accommodates the contact end 115.

Figure 16:
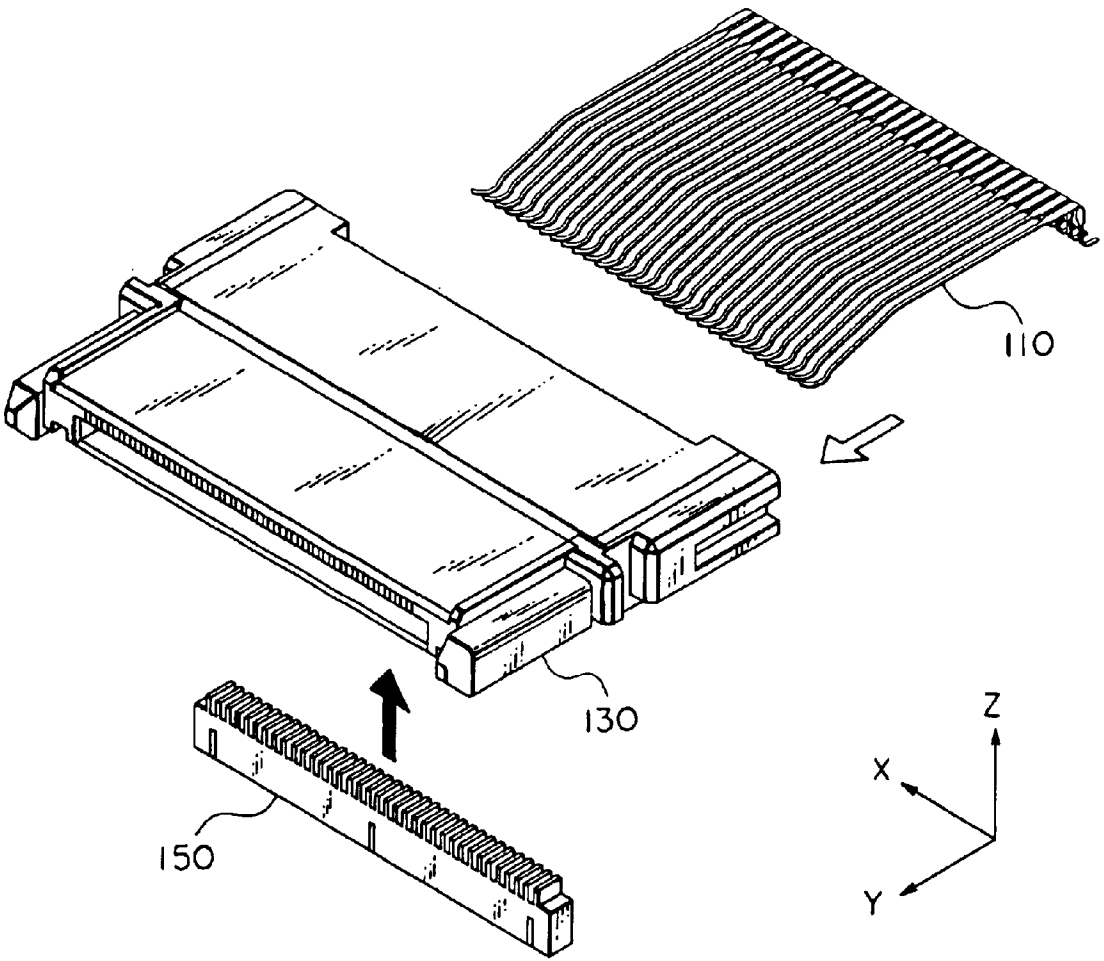
FIG. 16 is a perspective view showing a fabrication method of the connector of FIG. 2.

With reference to FIGS. 16 to 18, the fabrication method of the connector 100 will be explained now.

The contact pins 110 are tentatively inserted into the respective accommodation portions 132 from the rear end 134 towards the front end 133 along the Y-direction. However, the press-fit portions 133 are still not inserted into the respective accommodation portions 132, as shown in FIG. 17.

Under the state, the supplementary insulator 150 is fitted within the insulator 130 so that the supported portions are partially placed between the supplementary insulator 150 and the respective supporting surfaces 141, as shown in FIG. 18. In other words, the supplementary insulator 150 is inserted into the insulator 130 along the Z-direction so that the supplementary insulator 150 presses the supported portions 112 against the respective supporting surfaces 141.

Then, the contact pins 110 are further pressed into the respective accommodation portions 132 along the Y-direction until the contact pins 110 are completely inserted into the respective accommodation portions 132, as shown in FIG. 7. Upon the further pressing of the contact pins 110, the supplementary insulator 150 serves to suitably guide the insertion of the contact pins 110. Therefore, the supported portions 112 are positioned suitably.

What is claimed is:

1. A connector comprising:

a plurality of contact pins;

an insulator supporting the contact pins in a state arranged in a first direction;

each of the contact pins comprising a supported portion which extends in a second direction perpendicular to the first direction;

the insulator comprising a plurality of accommodation portions which accommodate the respective contact pins, the accommodation portions being arranged in the first direction and extending in the second direction, each of the accommodation portions being provided with a supporting portion which supports the supported portion of the corresponding contact pin, the supporting portion including a supporting surface which receives the supported portion of the corresponding contact pin in a third direction perpendicular to the first and the second directions; and a supplementary insulator extending in the first direction and fixedly held by the insulator, the supplementary insulator pushing at least one part of the supported portion of each of the contact pins to the supporting surface to hold the at least one part of the supported portion between the supporting surface and the supplementary insulator, and the supplementary insulator being partially fitted within the hole, while being in contact with the supported portions of the contact pins, the insulator being formed with a hole which extends in the first direction and communicates with the accommodation portions in the third direction.

2. The connector according to claim 1, wherein: each of the contact pins further comprises a terminal end, a connecting portion and a contact end; the supported portion has two ends; the terminal end is connected to one end of the supported portion; and the connecting portion extends from the other end of the supported portion in a direction oblique to the second and third directions and connects the other end of the supported portion and the contact end.

3. The connector according to claim 1, wherein each of the supporting portions of the accommodation portions has sidewalls in the first direction, and each of the supported portions of the contact pins is formed with a press-fit portion which is engaged in the sidewall of the supporting portion to fix the supported portion of the contact pin within the supporting portion.

4. The connector according to claim 3, wherein the press-fit portion is positioned nearer to the terminal end than to the contact end.

5. The connector according to claim 1, wherein the hole communicates an outside of the insulator with the accommodation portions in the third direction.

6. The connector according to claim 5, wherein: the supplementary insulator is comprised of a base portion and a plurality of pressing portions; the pressing portions are arranged in the first direction; and each of the pressing portions extends from the base portion in the third direction and is fitted within the corresponding accommodation portion to press at least one part of the supported portion of the corresponding contact pin against the supporting surface of the supporting portion of the corresponding accommodation portion.

7. The connector according to claim 1, wherein the supplementary insulator is provided with protrusions which are engaged in an inner wall of the hole of the insulator so that the supplementary insulator is partially press-fitted into the insulator.

8. The connector according to claim 1, wherein each of the accommodation portions has a T-like shaped cross-section in a plane perpendicular to the second direction, and the supporting portion is wider than the other portion of the accommodation portion in the first direction within the cross-section.

9. The connector according to claim 1, further comprising a shell which surrounds the insulator, the contact pins and the supplementary insulator.

10. The connector according to claim 9, wherein, the shell is formed with mounting posts for fixing the connector on an object.

11. A fabrication method of the connector according to claim 1, comprising the steps of:

tentatively inserting the contact pins into the respective accommodation portions along the second direction;

fitting the supplementary insulator to the insulator to press the supported portions against the supporting surfaces of the respective accommodation portions; and further pressing the contact pins into the respective accommodation portions along the second direction so that the contact pins are completely inserted into the respective accommodation portions.

* * * * *